US007798569B2

(12) United States Patent
Comarella

(10) Patent No.: US 7,798,569 B2
(45) Date of Patent: Sep. 21, 2010

(54) STORAGE BAG FOR STADIUM SEATS

(76) Inventor: Steven Sergio Comarella, 6245 Behner Way, Indianapolis, IN (US) 46250

( * ) Notice: Subject to any disclaimer, the term of this patent is extended or adjusted under 35 U.S.C. 154(b) by 0 days.

(21) Appl. No.: 12/210,792

(22) Filed: Sep. 15, 2008

(65) Prior Publication Data

US 2009/0079241 A1 Mar. 26, 2009

Related U.S. Application Data

(60) Provisional application No. 60/971,977, filed on Sep. 13, 2007.

(51) Int. Cl.
*A47C 7/62* (2006.01)

(52) U.S. Cl. ..... 297/188.2; 297/188.1; 297/188.12; 297/188.06

(58) Field of Classification Search ..... 297/219.1, 297/228.1, 224, 188.01, 188.08, 188.09, 297/188.1, 188.12, 188.13, 188.2, 188.06, 297/188.04; 383/40; 224/275, 38, 41
See application file for complete search history.

(56) References Cited

U.S. PATENT DOCUMENTS

| | | | | |
|---|---|---|---|---|
| 628,605 | A | 7/1899 | Ottenheimer | |
| 4,518,198 | A | 5/1985 | Daniels | |
| 4,546,507 | A | 10/1985 | Weinstein | |
| 4,650,103 | A * | 3/1987 | Mitchell | 224/275 |
| 4,676,376 | A | 6/1987 | Keiswetter | |
| D292,347 | S * | 10/1987 | Scott-Smith | D12/416 |
| 4,783,120 | A | 11/1988 | Kiechlin | |
| 4,892,353 | A | 1/1990 | Goddard | |
| D312,349 | S * | 11/1990 | Pogue | D12/416 |
| 5,005,901 | A | 4/1991 | Hinde | |
| 5,150,945 | A | 9/1992 | Aupperlee et al. | |
| 5,275,463 | A | 1/1994 | Rocha | |
| 5,326,152 | A | 7/1994 | Baron | |
| 5,414,881 | A | 5/1995 | Terrazas | |
| 5,421,637 | A | 6/1995 | Lemburg | |
| 5,620,229 | A | 4/1997 | Ledford | |
| 5,624,157 | A | 4/1997 | Kostuk | |
| 5,709,431 | A | 1/1998 | Horn | |
| 5,820,210 | A | 10/1998 | Shipman et al. | |
| 5,843,556 | A | 12/1998 | Levas | |
| 6,048,026 | A | 4/2000 | Barnett et al. | |
| 6,050,639 | A | 4/2000 | Horn | |
| D442,809 | S | 5/2001 | de Windt, Jr. et al. | |
| 6,386,761 | B1 * | 5/2002 | Bohnsack | 383/24 |
| 6,460,925 | B1 * | 10/2002 | Kovacs | 297/188.04 |
| 6,481,793 | B1 | 11/2002 | Horn | |
| 6,539,653 | B1 | 4/2003 | Finke | |
| 6,626,491 | B1 | 9/2003 | Blome et al. | |

(Continued)

FOREIGN PATENT DOCUMENTS

| | | |
|---|---|---|
| WO | WO9810683 | 3/1998 |

(Continued)

*Primary Examiner*—Milton Nelson, Jr.
(74) *Attorney, Agent, or Firm*—John V. Daniluck; Bingham McHale LLP

(57) ABSTRACT

A storage and advertising bag for a seat. In one embodiment, the bag includes a top pocket that slips over the top of a seat. On the other side of the bag is a top pocket that holds advertising material, and beneath that is a storage pocket for holding personal items of a user.

18 Claims, 10 Drawing Sheets

U.S. PATENT DOCUMENTS

| | | | | |
|---|---|---|---|---|
| 6,736,453 | B2 * | 5/2004 | Chambers et al. | 297/228.1 |
| 7,011,365 | B2 | 3/2006 | Kerfoot et al. | |
| 2003/0127890 | A1 | 7/2003 | Moon | |
| 2004/0075315 | A1 | 4/2004 | Patrick | |
| 2006/0283899 | A1 * | 12/2006 | Hill | 224/275 |
| 2007/0069560 | A1 | 3/2007 | Ranney | |
| 2007/0170757 | A1 | 7/2007 | Lanham et al. | |
| 2008/0061610 | A1 | 3/2008 | Tache | |

FOREIGN PATENT DOCUMENTS

| | | |
|---|---|---|
| WO | WO0133998 | 5/2001 |
| WO | WO03007275 | 1/2003 |
| WO | WO2005109986 | 11/2005 |

* cited by examiner

STORAGE BAG FOR STADIUM SEATS

CROSS REFERENCE TO RELATED APPLICATION

This application claims the benefit of priority to U.S. Provisional Patent Application Ser. No. 60/971,977, filed Sep. 13, 2007, which is incorporated herein by reference.

FIELD OF THE INVENTION

The present invention pertains to storage bags adapted and configured for mounting to a seat, and more particularly to such storage bags adapted to include advertising.

SUMMARY OF THE INVENTION

One aspect of the present invention pertains to a storage bag for a seat, the bag having multiple storage pockets.

Yet another aspect of the present invention pertains to a generally opaque storage bag that includes at least one transparent pocket for presentation of printed material.

Yet another aspect of the present invention pertains to a storage bag for placement over the back of a seat, the bag having a tapered pocket to slip over the back of the seat.

These and other aspects and features of various embodiments of the present invention will be apparent from the claims, text, and drawings that follow.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these myriad combinations is excessive and unnecessary.

DESCRIPTION OF THE PREFERRED EMBODIMENT

Figures 1, 2:
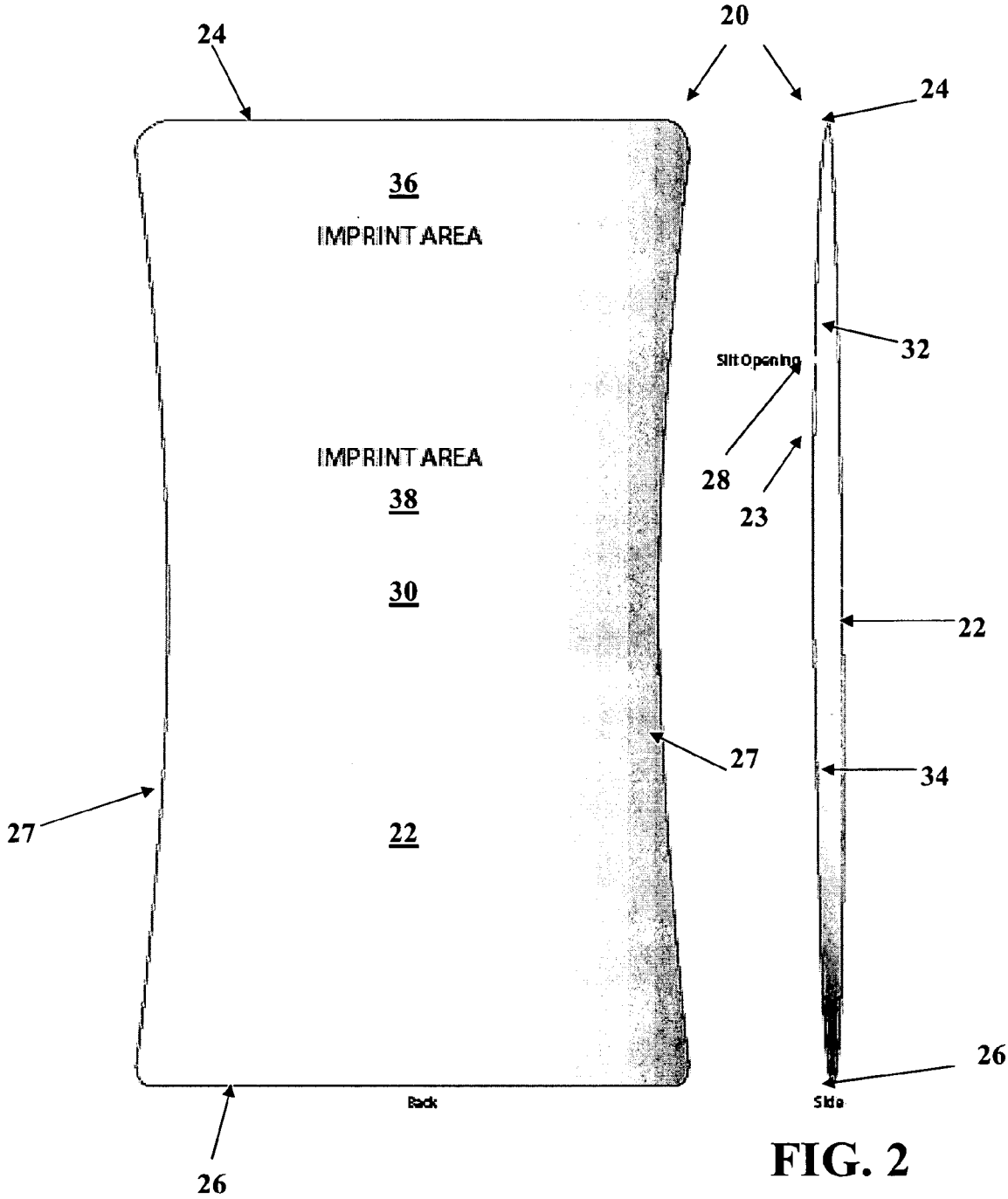
FIG. 1 is a frontal elevational view of a storage bag according to one embodiment of the present invention.
FIG. 2 is a side elevational cutaway view of the bag of FIG. 1 as taken down the center of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The use of an N-series prefix for an element number (NXX.XX) refers to an element that is the same as the non-prefixed element (XX.XX), except as shown and described thereafter. As an example, an element 1020.1 would be the same as element 20.1, except for those different features of element 1020.1 shown and described. As such, it is not necessary to describe the features of 1020.1 and 20.1 that are the same, since these common features are apparent to a person of ordinary skill in the related field of technology. Although various specific quantities (spatial dimensions, temperatures, pressures, times, force, resistance, current, voltage, concentrations, etc.) may be stated herein, such specific quantities are presented as examples only, and are not to be construed as limiting.

Some embodiments of the present invention pertain to a storage bag that can be easily mounted to a seat. In one embodiment the bag is adapted and configured to be mounted to either the seat back or the seat bottom of a folding seat, such as those found in stadiums for sporting events.

Yet another embodiment of the present invention pertains to a flexible and disposable storage bag that can be mounted to either a seat back or seat bottom of a folding seat. Some embodiments include multiple pockets. In one embodiment, there is a lower pocket for storage of sundry personal items, and a second, upper pocket for insertion and holding of printed material. In some embodiments, the upper pocket is transparent or translucent to permit reading of the written material in the pocket without removing the material from the pocket. However, other embodiments of the present invention are not so constrained, and the upper pocket can be substantially opaque.

In yet another embodiment of the present invention, there is a storage bag having multiple pockets and further having an appearance adapted and configured for presentation in public venues with multiple seats, such as stadiums, field houses, movie theaters, resort hotels and the like. As one example, the storage bag is prepared from a material having a color selected to be consonant with the public venue, such as team colors at a football stadium. Further, the storage bag includes a translucent pocket, either upper or lower for insertion of printed material, such as advertising or a team logo.

In one embodiment the storage bag is sealed or otherwise enclosed on all four edges, but also includes a slit or opening that extends across one face of the bag. The slit is positioned such that one portion of the bag can be fitted over a seat back or seat bottom, with the other portion of the bag extending downward from the seat back or seat bottom and not covering over any portion of the seat. This lower portion serves as a storage container for items such as clothing, blankets, cameras, newspapers, etc. that a seat occupant wants to protect from spilled beverages or other environmental contaminants.

In yet another embodiment of the present invention, the storage bag includes one or more areas of the front or rear faces of the bag on which a name, logo, design, trademark, or other printed material can be placed. Preferably, the printed material is placed on a bag face such that when the bag is attached to a seat back or seat bottom the printed material is visible to other spectators. In one embodiment, the printed material is placed on at least one face of the portion of the bag that covers the seat back or seat bottom.

Figure 3:
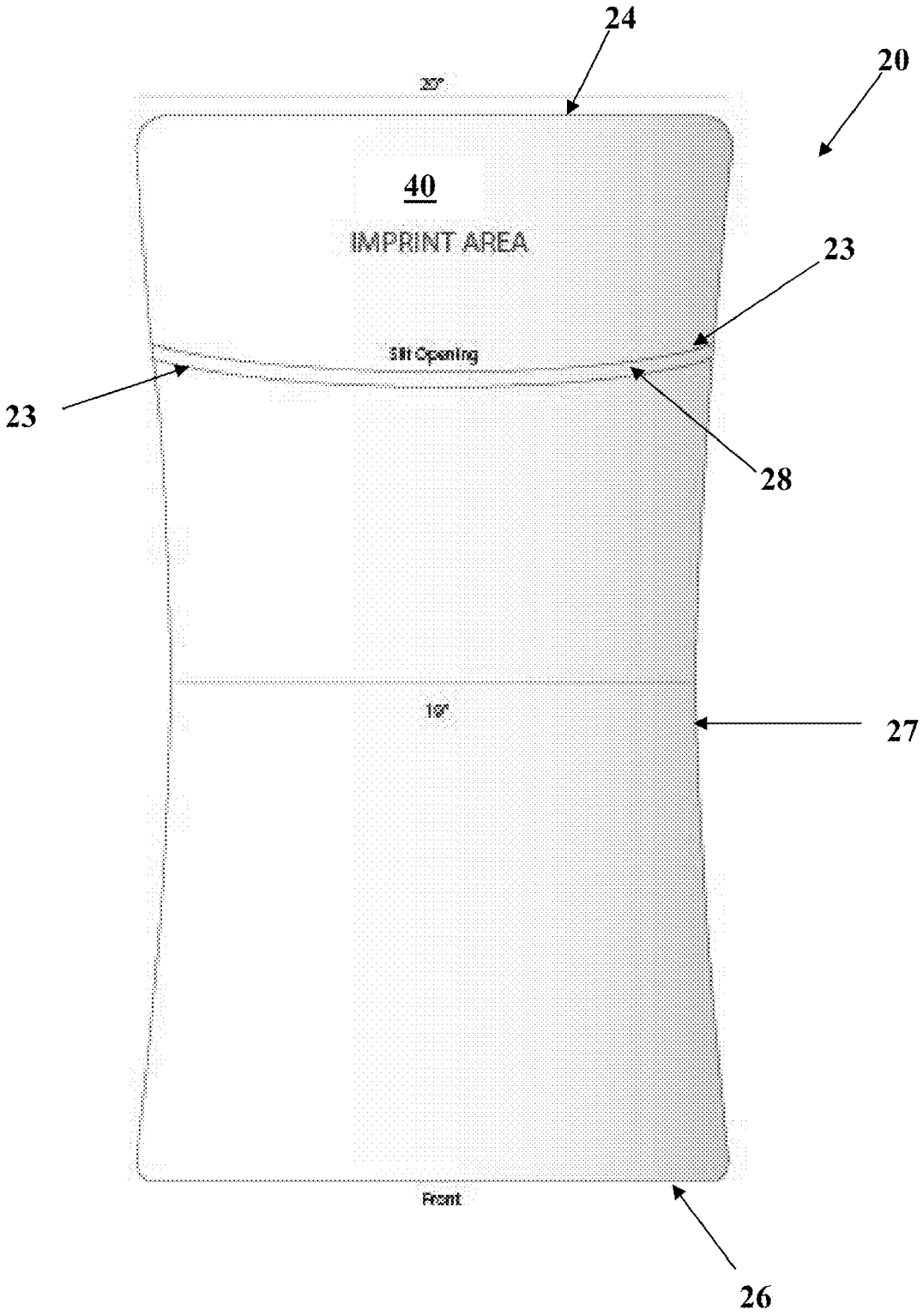
FIG. 3 is a rear elevational view of the apparatus of FIG. 1.

FIGS. 1, 2, and 3 show various views of a storage bag 20 according to one embodiment of the present invention. Bag 20 is preferably constructed from a sheet 22 of flexible material, such as plastic. However, the invention is not so limited, and other embodiments are comprised from sheets of other flexible material, including for example, cloth.

Sheet 22 preferably has a fold 24 along the top and a fold 26 at the bottom. The side edges 27 of sheet 22 are preferably sealed, such as by heat or ultrasonics, such that bag 20 is a sealed container except for the slit 28 extending across one face. The open edges 23 of the sheet are brought together along one face of the bag, as best shown in FIG. 3. These edges are preferably pressed apart to form a slit 28 therebetween. Preferably, the edges 23 are placed down from the top fold 24 by a distance of about one-fourth of the height of bag 20.

In one embodiment, slit 28 is placed to form an imprinting area 40 extending from slit 28 to the top fold 24. Referring to FIG. 1, on the opposite face of bag 20 imprinting areas 36 and 38 are located generally above and below, respectively, the location of slit 28.

Figure 4:
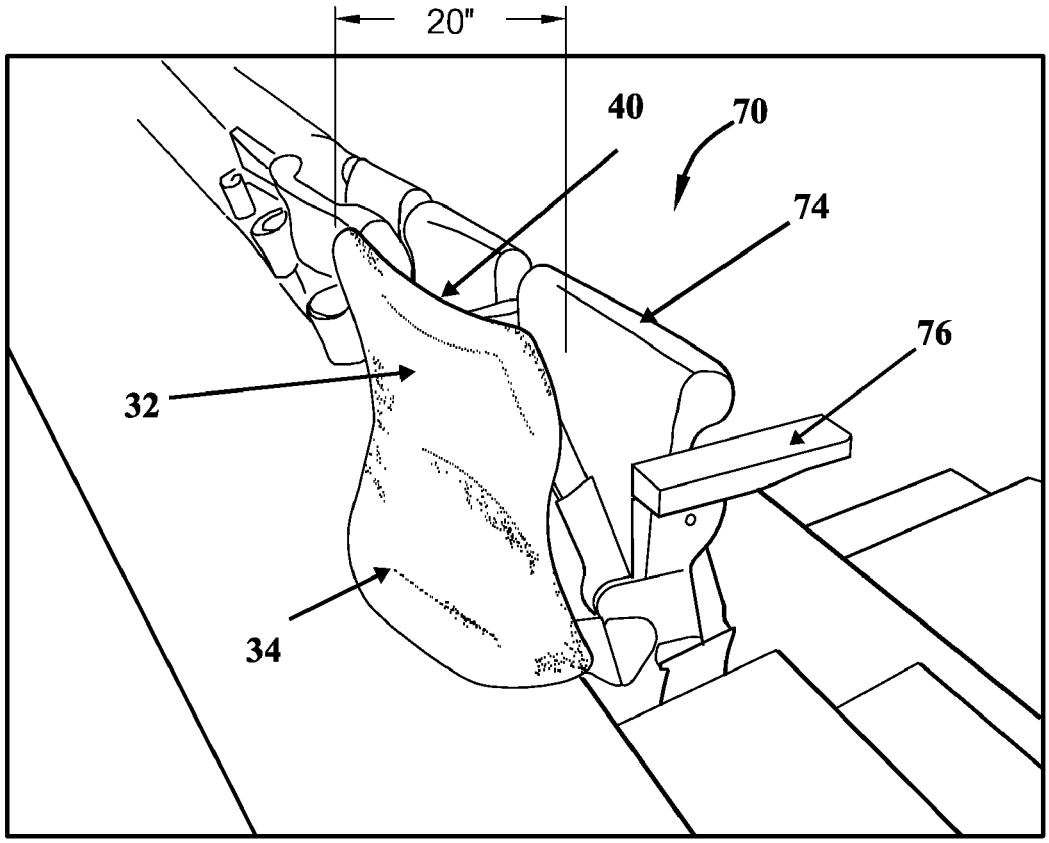
FIG. 4 is a perspective view of the apparatus of FIG. 1 as installed on a seat back.

Slit 28 defines a boundary between an upper seat attachment portion 32 and a lower storage portion 34, both within the interior of bag 20. Preferably, slit 28 is located a distance from top fold 24 that is less than the distance from the top of a seat back to the arm rest of a seat, as can be seen in FIG. 4. The storage portion 34 of bag 20 extends downwardly from slit 28, with slit 28 providing access for a seat occupant to place objects within storage area 34. In some embodiments the distance from slit 28 to bottom fold 26 is long enough that bottom fold 26 contacts the floor of the stadium behind the seat. In such embodiments relatively heavy objects can be placed in storage area 34 without concern for creating too much stress in the sidewalls of bag 20. In yet other embodiments the distance from slit 28 to bottom fold 26 is shorter, such that the bottom of the bag does not rest on the floor behind the seat.

As best seen in FIGS. 1 and 3, in some embodiments bag 20 has side edges 27 that are slightly concave toward the center of the bag. As one example, in one embodiment the width of bag 20 along top fold 24 is about 20 inches, and the minimum width of bag 20 through the bag midsection is about 19 inches. This slight reduction in the width through the midsection creates an aesthetically pleasing appearance. In yet other embodiments, a reduction in width is helpful in retaining seat attachment portion 32 onto the seat back, such that the seat attachment portion 32 is a more snug fit across the middle of the seat back than at the top of the seat back.

Although various embodiments are described herein with respect to stadium-type seats, it is understood that the bags are also usable with other types of seats, including as examples seats in movie theaters, airplanes, boats, automobiles, and buses.

Figure 5:
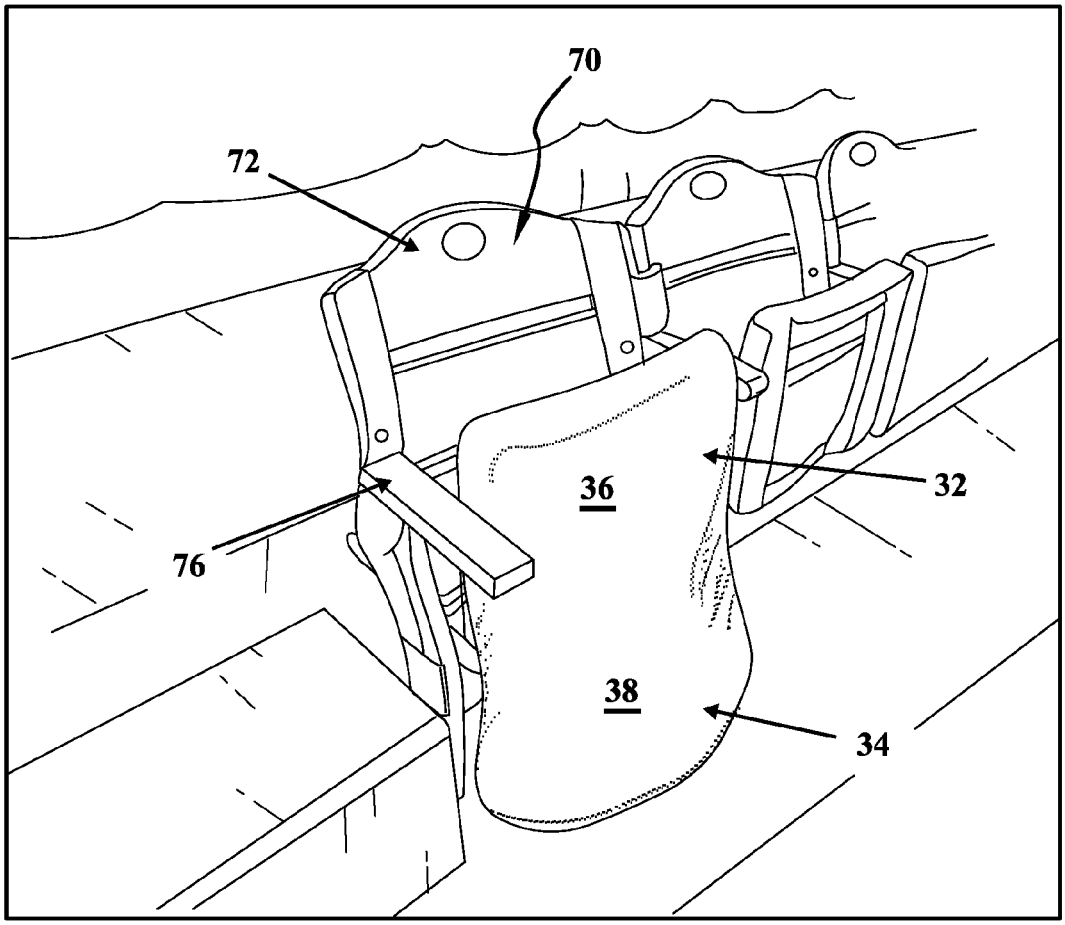
FIG. 5. is a perspective view of the apparatus of FIG. 1 as installed on a seat bottom.
Figure 6:
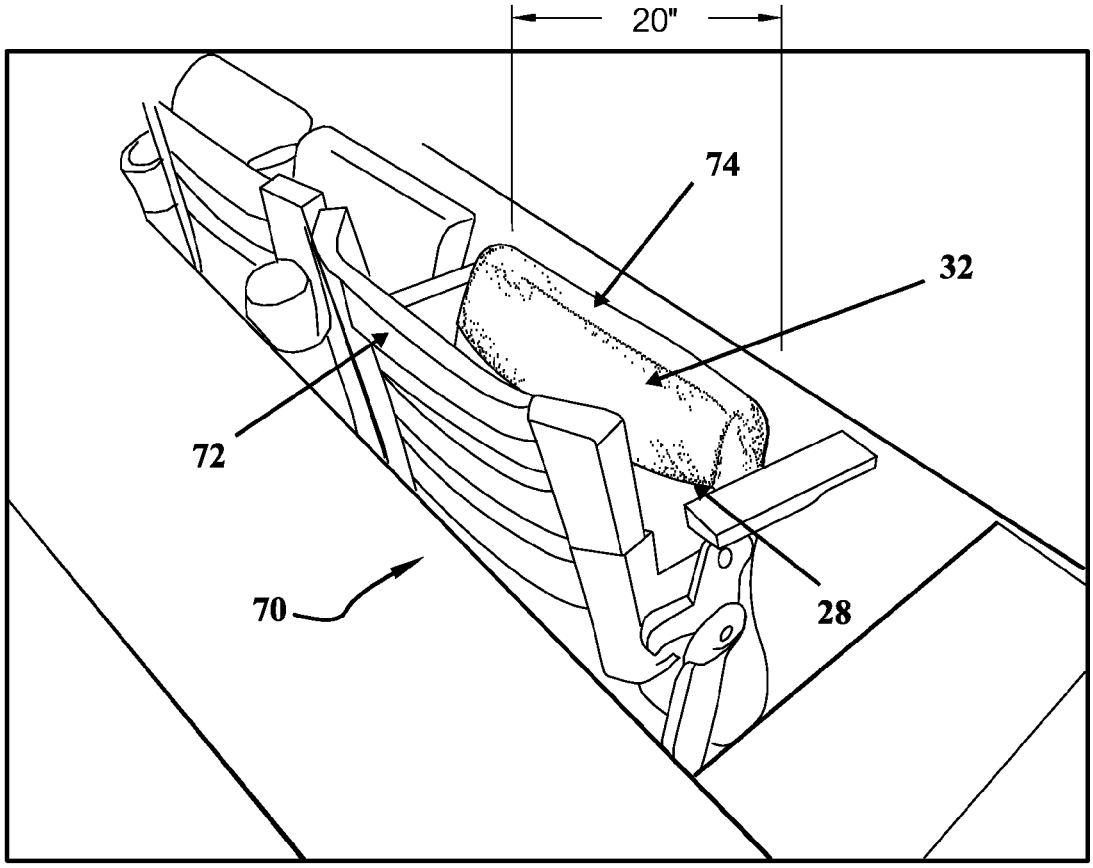
FIG. 6 is a perspective view of the seat of FIG. 5.

FIGS. 4, 5, and 6 are various perspective views of storage bag 20 attached to a chair. In one embodiment, bag 20 is adapted and configured to fit over the seat back 72 of a stadium seat 70. Seat 70 includes a seat back 72, multiple arm rests 76, and a seat bottom 74 that preferably folds upward. A spectator in the stadium (which can be the holder of seat 70 or the holder of the seat behind seat 70) opens bag 20 along slit 28 and slides seat attachment portion 32 over seat back 72 (attachment 32 can also cover a portion of the seat back 72). As shown in FIG. 4 the seat attachment 32 of bag 20 is placed over the top of seat back 72. The bottom storage section 34 of seat back 20 thereby hangs behind seat 70, and in some embodiments rests on the floor behind seat 70. In yet other embodiments, the low storage section 34 of bag 20 is adapted and configured to hang from seat back 72 without touching the floor behind the seat. As shown in FIG. 4, the slit opening 28 that provides access to storage section 34 is located next to the back of seatback 72, such that rain and other debris are shielded from easily falling into the storage section 34.

FIGS. 5 and 6 show a storage bag 20 as attached to a seat bottom 74. Referring to FIG. 6, the occupant of seat 70 opens bag 20 along opening 28 and slides the seat attachment portion 32 of bag 20 over the forward edge of seat bottom 74. Referring to FIG. 5, the storage portion 34 of the attached bag 20 hangs downward. In some embodiments the total height of bag 20 is selected such that storage portion 38 does not rest on the ground when the seat bottom 74 is folded upward. In yet other embodiments the storage portion 38 is always supported by the floor beneath seat 70, so as to minimize stresses in the bag sidewall.

As best seen in FIG. 4, the upper imprint area 40 is clearly visible from the front of seat 70 and likewise from the center of the stadium. Referring to FIG. 5, both the upper and lower imprinting areas 36 and 38 are visible from the front of seat 70 and likewise from the center of the stadium when the seat bottom is folded up. Referring to FIG. 4, the lower imprinting area 38 is readily visible to the person occupying the seat behind seat 70. In one embodiment, upper imprinting area 40 has printed on it a design or logo that is readily visible from a long distance, such as from seats on the other side of the stadium and also from television camera in the stadium. In yet another embodiment, lower printing area 38 has placed on it a design or information that provides a message to a nearby individual (such as the occupant in the seat behind seat 70) for his information or enjoyment. Referring to FIGS. 3 and 4, in one embodiment upper imprinting area 40 is defined from top of fold 24 to slit 28.

Figures 7, 8:
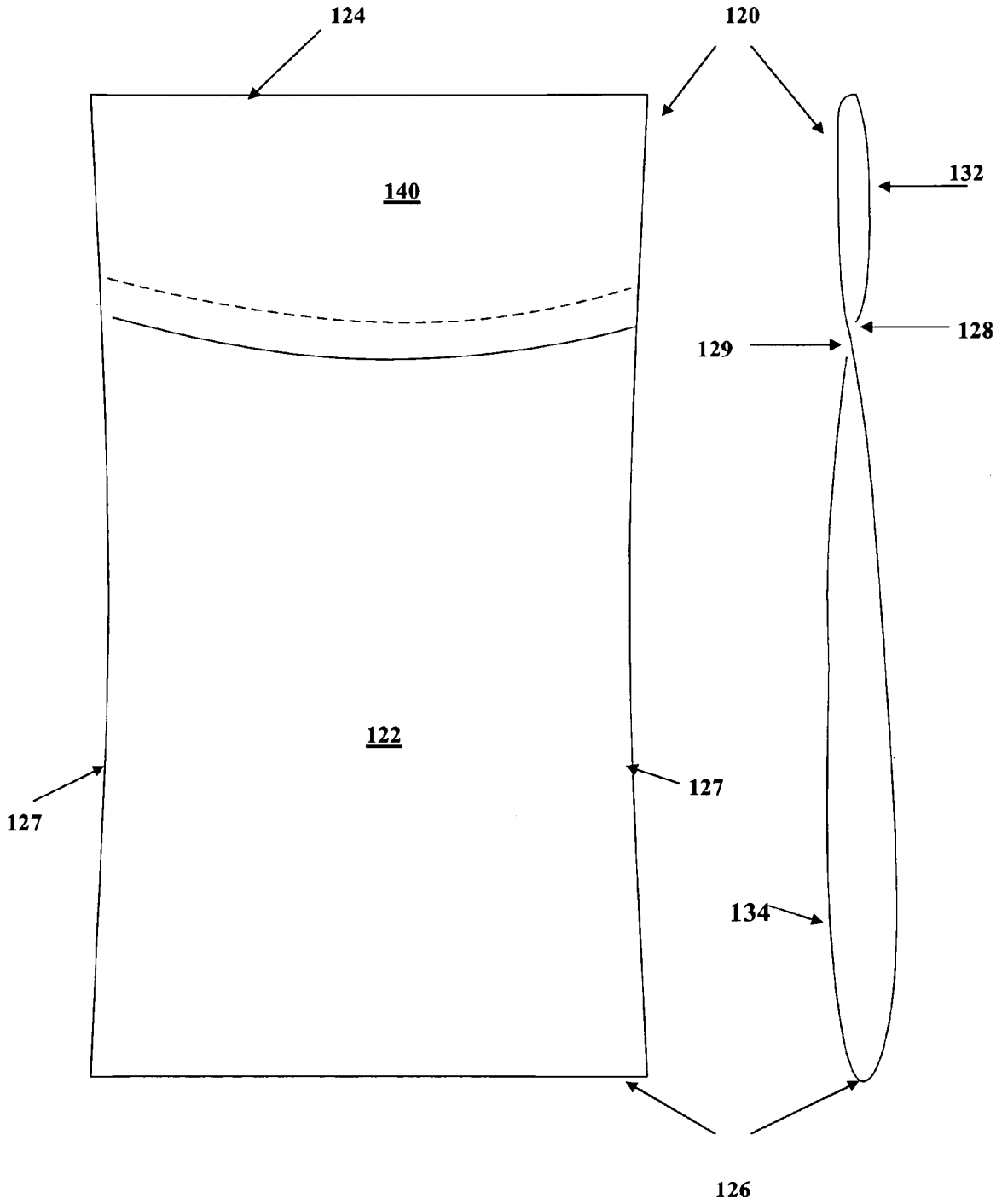
FIG. 7 is a front elevational view of a bag according to another embodiment of the present invention.
FIG. 8 is an elevational cutaway view of the bag of FIG. 7 as taken down the center of FIG. 7.

FIGS. 7 and 8 show a storage bag 120 according to another embodiment of the present invention. Storage bag 120 is the same as bag 20 except that sheet 122 is folded in an approximate "S" shape, as best seen in FIG. 8. Storage Bag 120 includes a fold 124 along the top and a fold 126 at the bottom. The side edges 127 of sheet 122 are preferably sealed. Bag 120 is constructed such that there is a forward slit 128 which provides access to seat covering portion 132 and a second opening 129 that provides access to storage section 134. An imprinting area 140 extends from slit 128 to the top fold 124. Referring to FIGS. 4 and 5, a bag 120 mounted on a seat back (such as shown in FIG. 4) would include a rear-facing slit 129 that provides access to storage section 134 from behind seat 70. Referring to FIG. 5, a storage bag 120 coupled to the seat bottom would include a forward facing slit 128 accessible from the front of seat 70.

Figure 9:
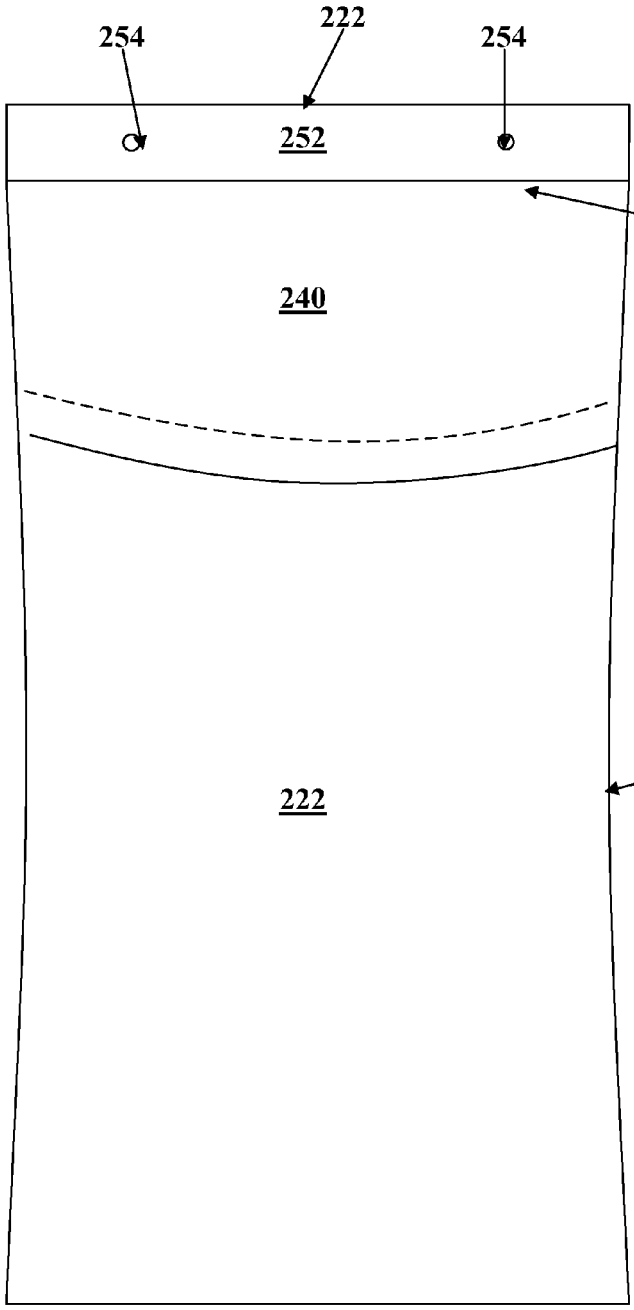
FIG. 9 is a front elevational view of a storage bag according to another embodiment of the present invention.
Figure 10:
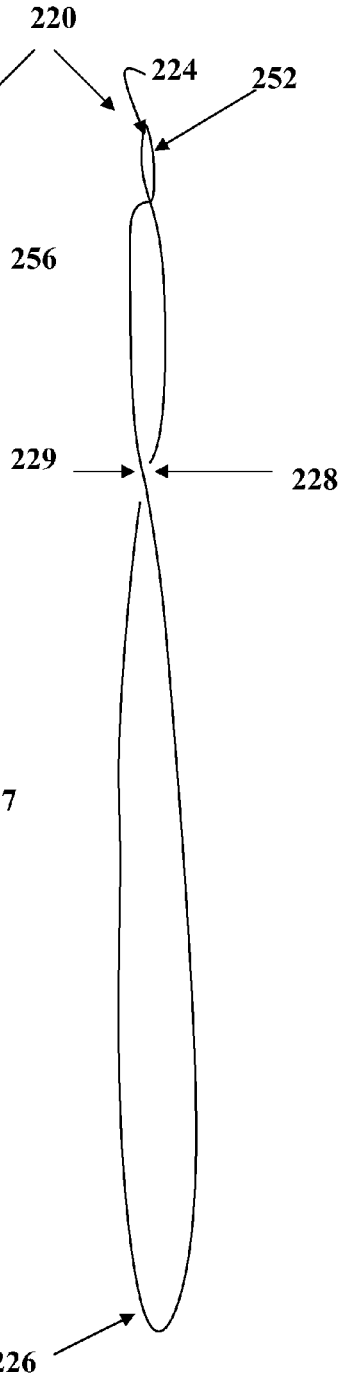
FIG. 10 is a side elevational cutaway view of the storage bag of FIG. 9 as taken down the center of FIG. 9.

FIGS. 9 and 10 show a storage bag 220 according to another embodiment of the present invention. Storage bag 220 includes a fold 226 at the bottom. The side edges 227 of sheet 222 are preferably sealed. Bag 220 is constructed such that there is a forward slit 228 and a second opening 229. Storage bag 220 is the same as storage bag 120 except that sheet 222 has been arranged to provide a tear-off strip 252 as best seen in FIG. 10. Tear off strip 252 is an upward extension of sheet material 222. Bag 220 includes a top fold 224 which extends along the top of header strip 252. The front and rear faces of sheet 222 are then attached to each other along a perforated strip 256. Tear off strip 252 further includes a pair of through holes 254.

In one embodiment bag 220 can be hung from a pair of hooks or posts from the two holes 254. A seat holder can pull the bottom of bag 220, which will then separate from header strip 252 along perforated area 256. Bag 220 thus provides a convenient means for providing a supply of storage bags to the stadium seat holders.

In yet other embodiments, a plurality of bags are provided in a roll. The roll can include individual bags loosely rolled together as well as individual bags attached to each other along edges that are perforated for easy separation.

Figure 11:
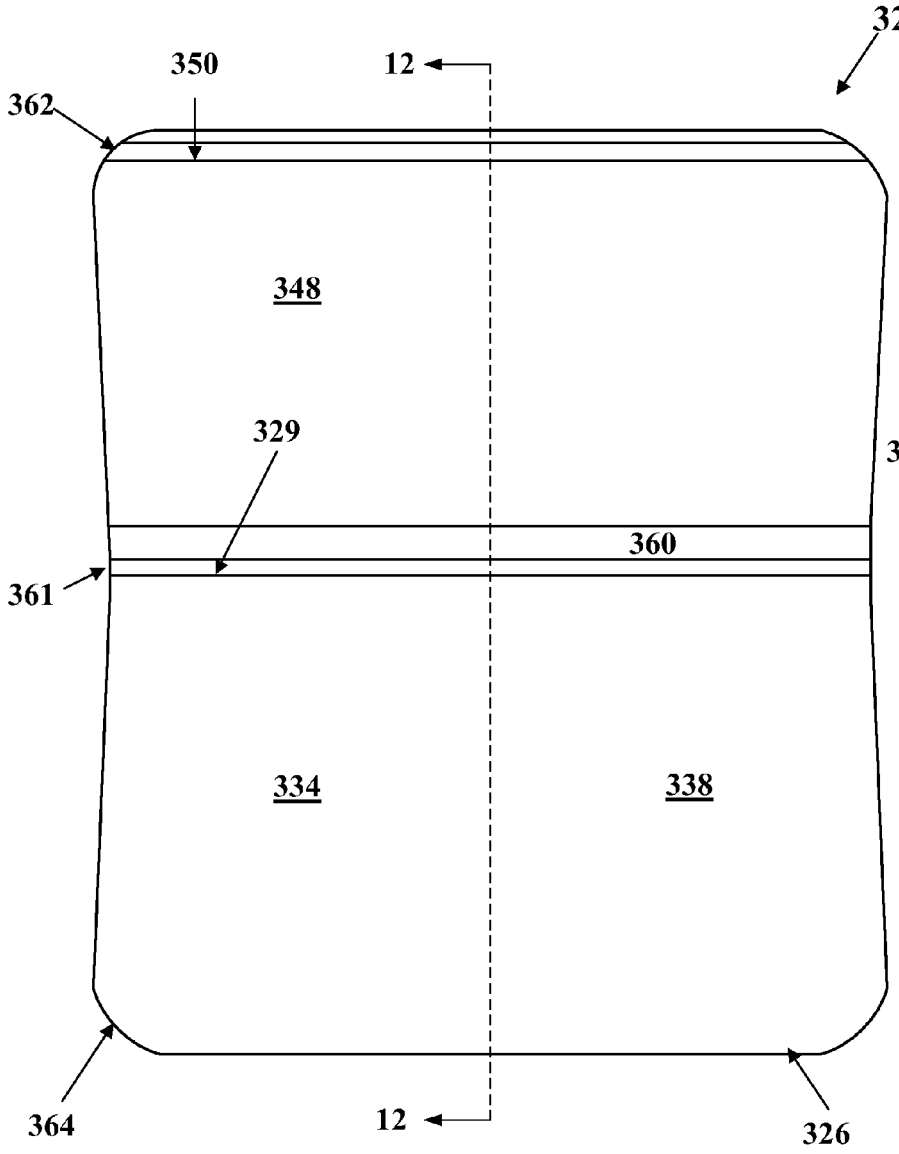
FIG. 11 is an elevational view of one side of a storage bag according to another embodiment of the present invention.
Figure 12:
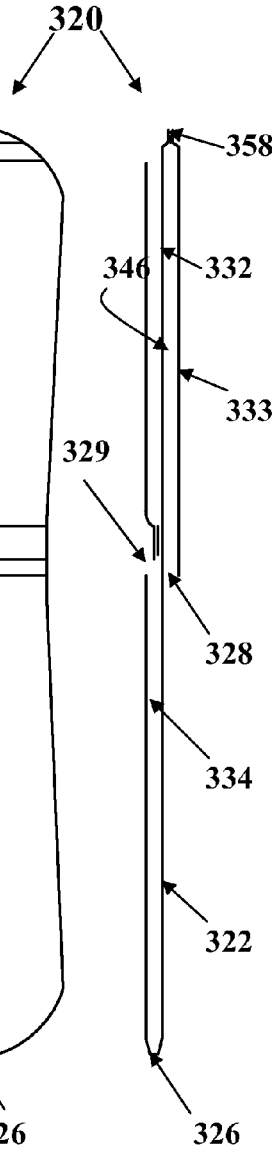
FIG. 12 is a drawing of the bag of FIG. 11 as taken along line 12-12 of FIG. 11.
Figure 13:
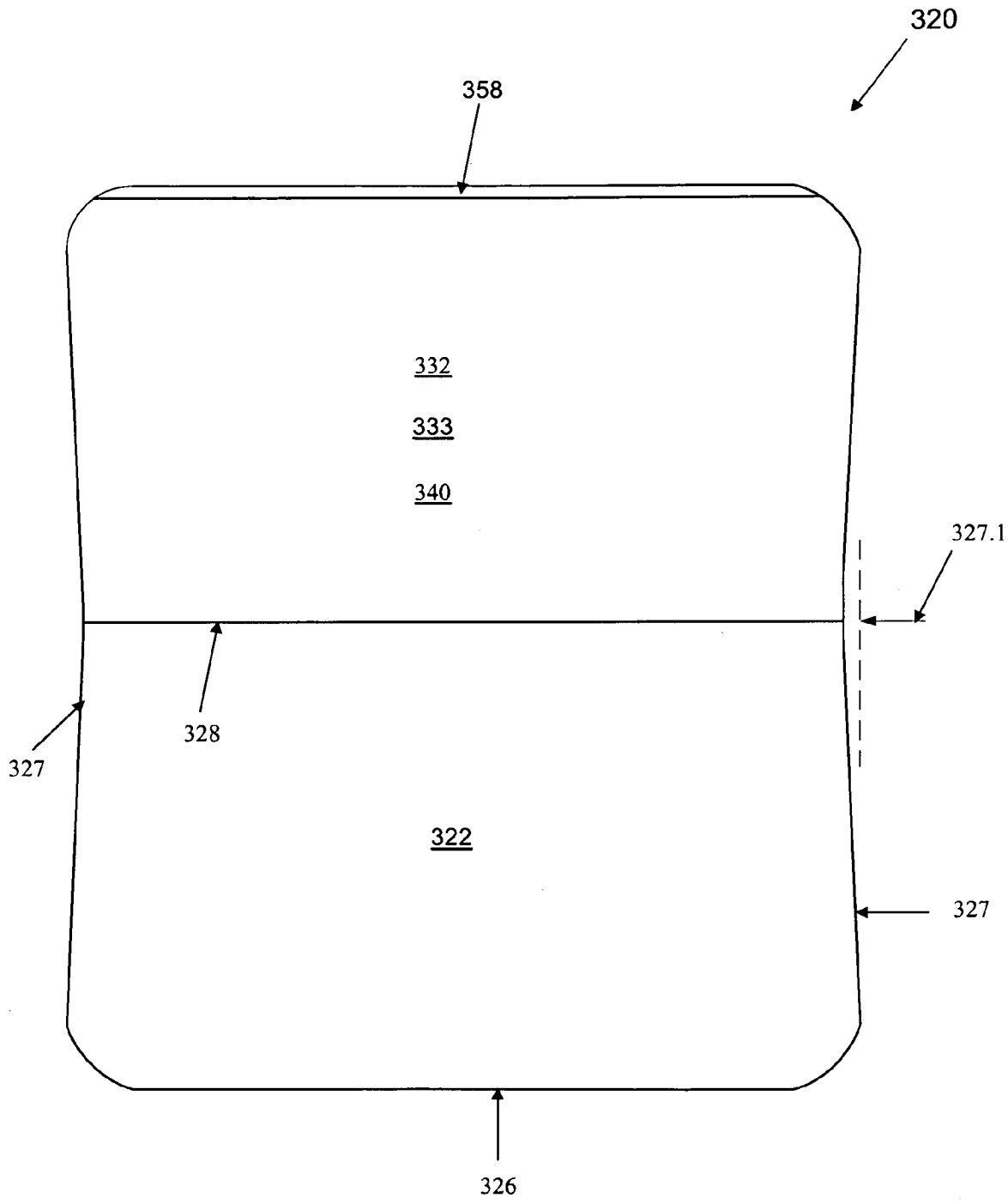
FIG. 13 is an elevational view of the other side of the bag of FIG. 11.

FIGS. 11, 12, and 13 depict various views of a storage bag 320 according to another embodiment of the present invention. Storage bag 320 includes a first, downward-facing pocket 332 on one side of bag 320. A second, upward-facing pocket 346 is on the other side of bag 320, and generally opposite of pocket 332. A third storage pocket 334 is located on the same side as pocket 346, with an upward-facing opening. Bag 320 includes an imprinting area 338 located generally below the location of slit 328.

As best seen in FIG. 12, bag 320 can be constructed from a sheet 322 of flexible material, such as plastic, extending from a top seam 358, down to a bottom fold 326, and up to a pocket opening 329 located generally midway from the top to the bottom of the bag. These right and left edges 327 of sheet 322 are fused so as to form a three-sided, upward-facing storage pocket 334.

Bag 320 further includes a sheet of flexible material 333 (such as plastic) that extends downwardly from a top seam 358 to a point generally midway from between the top and bottom of bag 320, so as to form a downward-facing opening 328. The edges of sheet 333 and upper edges of sheet 322 are fused together along the right and left so as to form a three-sided, downward-facing pocket 332 that is configured to slip over the back of a seat or over the folded bottom of a seat.

Again referring to FIG. 12, bag 320 further includes a second pocket generally along the top half of bag 320. This second top pocket 346 extends upwardly from a fused seam 360 across which sheet 348 is attached to sheet 322. The edges of sheet 348 are fused to edges of sheet 322 so as to form a three-sided, upward-facing pocket 346 having an opening 350 generally extending across the width of bag 320. Preferably, sheet 348 is fabricated from a plastic material that is at least partially transparent, so as to permit a person facing pocket 346 to observe printed material (such as advertising, a logo, or informational material) that has been inserted into pocket 346. In some embodiments, sheet 348 is substantially transparent.

Bag 320 includes a top seam 358 and a middle seam 360 along the waist 361 of bag 320. Top seam 358 and middle seam 360 are preferably fused together (such as by ultrasonics or heat) or adhered together. Further, in some embodiments of the present invention, sheet 333 and sheet 322 are integral, so as to form a general "S" shape.

As best seen in FIGS. 11 and 13, bag 320 has edges 327 that are concave inward, so as to form a waist 361 having a width that is less than the top or bottom of bag 320. Further, bag 320 preferably includes rounded bottom corners 364 and rounded top corners 362. Referring to FIG. 13, it can be seen that midway between the top and bottom of bag 320 the width of the bag is reduced, as indicated by arrow 327.1. In one embodiment, this reduced-width portion is anywhere from about one-half inch to about two inches.

As can be seen best in FIGS. 11 and 13, the pocket 332 of bag 320 (which can also attach to the seat) is tapered along the opening 328. The size of opening 328 is adapted and configured to fit snugly over a typical seat back. This snug fit helps maintain the bag 320 in position. In those applications where pocket 332 is slipped over the back of the seat, it is recognized that one surface of bag 320 will contact the upper back and shoulders of a person sitting in that seat. By having the upper portions of pocket 332 extend more widely than the opening, it has been found that there is reduced stress on this upper portion of the back if the seat occupant shifts his position. Further, by having a snug opening, it is less likely for disturbances such as a gust of air to enter opening 328 and attempt to lift off a bag 320 that does not have any items weighing it down in pocket 334. In some embodiments of the present invention, bag 320 is fabricated from a stretchable material to further assist in achieving a snug fit. In yet other embodiments, an elastic strap is attached around the front and/or back sides of pocket 332 in the vicinity of waist area 361.

Storage section 334 is adapted and configured to safely hold sundry items of the occupant of the seat, such as a coat, magazines, hats, and the like. Preferably, storage section 334 has a bottom that is wider than the upward facing opening of the pocket, which, combined with rounded bottom corners 364, provides greater storage volume toward the bottom of pocket 334. This construction method helps to safely let stored items drop to the bottom of pocket 334, making them less likely to spill out of or extend from opening 329. Further, in some embodiments, pocket 334 has a bottom 326 that is adapted and configured to contact the surface under the seat. This combination of increased length, wide bottom, and rounded corners reduces the stress in the bag corners, making the bag less likely to fail.

The top pocket 346 is preferably shaped to securely retain advertising material that is located therein. Referring to FIG. 11, it can be seen that the opening 350 of pocket 346 is located midway along the rounded corners 362, such that the internal width of the pocket near the top is greater than the width of the opening 350. In such embodiments, it is preferably to insert a sheet of advertising material that is slightly longer than the width of the opening 350, with the result that the corners of the inserted material are secured in the top, rounded portions of the pocket. In this configuration, the corners of the advertising material are retained within the pocket, and less likely to escape because of a disturbance such as a gust of wind.

Figure 14:
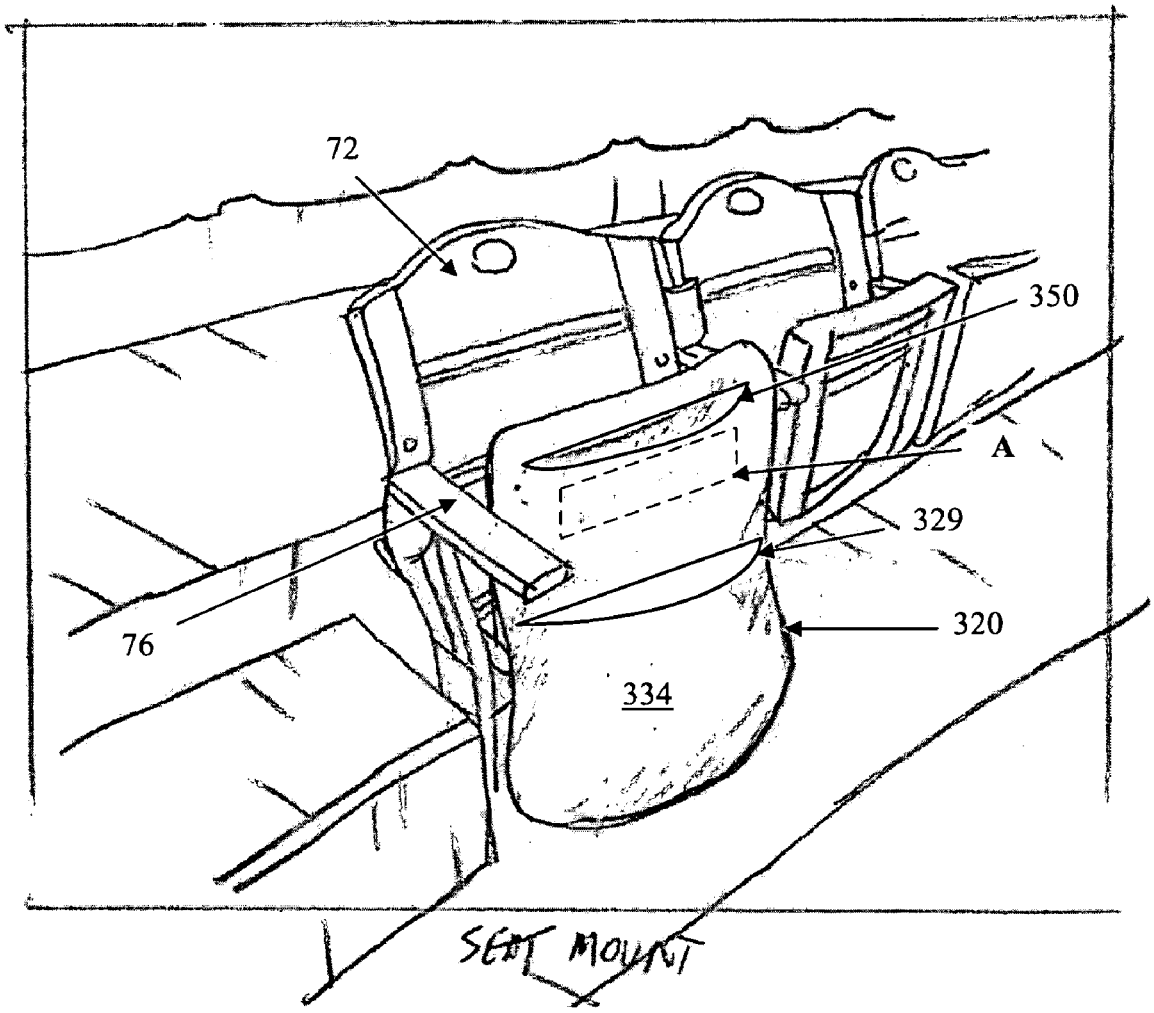
FIG. 14 is a perspective view of the apparatus of FIG. 11 as installed on a seat bottom.

Referring to FIG. 14, apparatus 320 is shown placed on the bottom of a folded seat. In this application, pocket 332 is placed around the leading edge of the seat bottom. When the seat is folded, top pocket 346 extends horizontally and storage pocket 334 extends downward. A placard A having printed material is shown inserted in top pocket 346 and is readable through transparent material 346. As a user comes to his seat, the user can place his coat or other items in the bottom pocket 334, which will be safely protected from the weather when the seat bottom is folded forward. The placard A is readable as the user approaches the seat. In some embodiments, bottom 362 of bag 320 is adapted and configured to have a length wherein the bottom of the bag touches the walking surface of the seating area. Various embodiments of the present invention contemplate pockets (which can also be attachment portions) 332 adapted and configured for a variety of different seat bottoms, including padded seat bottoms.

In some embodiments, the colors of the sheets 333, 332, and 348 are selected to create a visual theme among the seats. In one embodiment, sheets 322 and 333 are selected from a range of colors. As one example, for a sports team having team colors of purple and gold, the sheets 322 and 333 are fabricated from plastic sheets including one or both of those colors. Preferably, the sheets are opaque, providing a more uniform visual effect of the seats. In one embodiment, sheet 348 is substantially transparent, and the pocket 346 is intended to hold written material, which could be a team logo, advertisement, or other informational material.

In one embodiment of the present invention the depth of pocket 334 from opening 329 to bottom 326 is about 16 inches. The maximum width of pocket 334 at the point of maximum outward taper is about 23 inches. The width of opening 329 is about 22 inches.

In another embodiment the depth of pocket 332 from opening 328 to sealed area 358 is about twelve and one-half inches. The width of pocket 332 across opening 328 is about 22 inches. The width of the pocket 332 across its most-tapered outward points is about 23 inches. The opening 350 of pocket 348 is about twenty one and a half inches.

Although what has been shown and described herein is a bag having multiple pockets, and especially bags including one transparent pocket, fabricated from plastic material such as polypropylene, the invention is not so constrained. Yet other embodiments include fabrication of the bag from various flexible materials, including cloth. A cloth bag having multiple pockets is adapted for applications such as folding chairs by the swimming pools of a resort hotel.

The various embodiments described herein have been described with reference to particular materials, dimensions, and methods of construction. However, this is by way of example, and the invention is not so limited. Also, it is understood that the various features shown herein can be combined. As one example, the header strip 252 can also be incorporated on bag 20. Further, it is understood that the various bags described herein can be manufactured by various methods.

While the inventions have been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flexible bag for a folding seat, comprising:

a first pocket with a downward facing opening on one side of the bag, said first pocket being adapted and configured to slip over the bottom of a folding seat;

a second pocket with an upward facing opening on the other side of the bag, said second pocket being at least partly covered with a material that is at least partially transparent, the opening of said second pocket being above the opening of said first pocket; and a third pocket with an upward facing opening on said other side of the bag, the opening of said third pocket being below the opening of said second pocket, the opening of said third pocket having a first width and the bottom of said third pocket having a second width, and the first width is less than the second width.

2. The bag of claim 1 wherein the bag has a right edge, a left edge, a top, and a bottom, and the right and left edges are concave inward, such that the bag has a reduced-width waist midway from the top to the bottom.

3. The bag of claim 1 wherein said first pocket is fabricated from a stretchable material.

4. The bag of claim 1 wherein the opening of said first pocket has a width and the top of said first pocket has a width, and the opening width is less than the top width.

5. The bag of claim 1 wherein the opening of said first pocket has a width that is greater than about nineteen inches.

6. The bag of claim 1 wherein the opening of said third pocket has a width that is greater than about nineteen inches.

7. The bag of claim 1 wherein the covering material of said second pocket is substantially transparent.

8. The bag of claim 1 the third pocket is adapted and configured to hang from underneath the bottom of the seat.

9. The bag of claim 1 wherein the third pocket has a length, and the length is adapted and configured to contact a surface under the seat when the seat bottom is folded up.

10. The bag of claim 1 wherein said first pocket is fabricated from a flexible material that can be stretched over the bottom of a seat.

11. The bag of claim 1 wherein said first pocket and said second pocket are substantially opaque and substantially the same color.

12. A flexible bag for covering a folding seat, comprising:

a flexible top pocket including a front wall and back wall joined at opposite sides, said top pocket having a first bottom and downward facing first opening, the first bottom having a width that is wider than the first opening, said top pocket being adapted and configured to fit over the leading edge of the bottom of the seat; and a flexible bottom pocket including a front wall and back wall joined at opposite sides, said bottom pocket having a second bottom and an upward facing second opening, the second bottom having a width that is wider than the second opening;

wherein the back wall of said top pocket and the back wall of said bottom pocket form a common wall having two opposing faces, the first opening is along one face, and the second opening is along the opposing face, and said bottom pocket extends downward and underneath the unfolded seat when said top pocket is fit over the leading edge.

13. The flexible bag of claim 12 wherein the back wall of said top pocket and the back wall of said bottom pocket are integral.

14. The flexible bag of claim 12 wherein the first bottom is at the top of the common wall and the second bottom is at the bottom of the common wall.

15. The flexible bag of claim 12 wherein the common wall has first and second sides extending from the top of the common wall to the bottom of the common wall, and the first and second sides have a midsection that is less wide than at least one of the top of the common wall or the bottom of the common wall.

16. The flexible bag of claim 12 wherein the first opening and the second opening are joined at a midsection, the first bottom is above the midsection, and the second bottom is below the midsection.

17. The flexible bag of claim 12 wherein the common wall has first and second sides extending from the top of the common wall to the bottom of the common wall, and the first and second sides have a midsection that is generally concave inward.

18. The flexible bag of claim 12 wherein the width of the first opening is about the same as the width of the second opening.

* * * * *